US011390982B1

(12) United States Patent
Hammond et al.

(10) Patent No.: US 11,390,982 B1
(45) Date of Patent: Jul. 19, 2022

(54) PORTABLE WASHER AND DRYER

(71) Applicants: Aaron Hammond, Smyrna, GA (US); Shedra Hammond, Smyrna, GA (US)

(72) Inventors: Aaron Hammond, Smyrna, GA (US); Shedra Hammond, Smyrna, GA (US)

( * ) Notice: Subject to any disclaimer, the term of this patent is extended or adjusted under 35 U.S.C. 154(b) by 350 days.

(21) Appl. No.: 16/783,123

(22) Filed: Feb. 5, 2020

Related U.S. Application Data

(60) Provisional application No. 62/802,272, filed on Feb. 7, 2019.

(51) Int. Cl.

| | |
|---|---|
| ***D06F 39/12*** | (2006.01) |
| ***D06F 13/00*** | (2006.01) |
| ***D06F 15/00*** | (2006.01) |
| ***D06F 18/00*** | (2006.01) |
| ***D06F 45/12*** | (2006.01) |
| ***D06F 58/12*** | (2006.01) |
| ***D06F 58/14*** | (2006.01) |
| ***D06F 58/20*** | (2006.01) |
| ***D06F 39/08*** | (2006.01) |
| ***D06F 58/26*** | (2006.01) |

(52) U.S. Cl.
CPC ..... *D06F 39/12* (2013.01); *D06F 13/00* (2013.01); *D06F 15/00* (2013.01); *D06F 18/00* (2013.01); *D06F 39/088* (2013.01); *D06F 45/12* (2013.01); *D06F 58/12* (2013.01); *D06F 58/14* (2013.01); *D06F 58/206* (2013.01); *D06F 58/26* (2013.01)

(58) Field of Classification Search
CPC ..... D06F 39/12; D06F 13/00; D06F 15/00; D06F 18/00; D06F 45/12; D06F 58/12; D06F 58/14; D06F 58/206; D06F 39/088; D06F 58/26
See application file for complete search history.

(56) References Cited

U.S. PATENT DOCUMENTS

| | | | | | |
|---|---|---|---|---|---|
| 2,692,494 | A * | 10/1954 | Candor | D06F 13/00 | 68/21 |
| 2,701,921 | A * | 2/1955 | Strongson | D06F 58/14 | 219/400 |
| 2,705,377 | A * | 4/1955 | Koastandt | D06F 58/14 | 34/233 |
| 2,749,735 | A * | 6/1956 | Candor | D06F 47/06 | 68/21 |
| 3,065,621 | A * | 11/1962 | Sam | D06F 35/00 | 68/148 |
| 3,254,514 | A * | 6/1966 | McCarthy | D06F 5/005 | 68/4 |

(Continued)

*Primary Examiner* — Benjamin L Osterhout
(74) *Attorney, Agent, or Firm* — Fish & Richardson P.C.

(57) ABSTRACT

A portable apparatus for washing and drying clothes, and a method of manufacturing said apparatus, are described. In one aspect an apparatus includes a washing unit and a drying unit. The washing unit includes a washing compartment configured to be collapsible, a water tube connected from a top washer end to a bottom washer end of the washing unit, a water hose extending from a side wall of the washing unit, and a wringer coupled to an end of the washing compartment. The drying unit includes a drying compartment, a power compartment, a fan assembly at the top dryer end and coupled to the drying compartment, a heating assembly, and an air vent. In one aspect the drying unit is coupled to the washing unit.

21 Claims, 12 Drawing Sheets

(56) References Cited

U.S. PATENT DOCUMENTS

| | | | | |
|---|---|---|---|---|
| 3,318,117 | A * | 5/1967 | Guillermo | D06F 15/02 68/152 |
| 3,432,939 | A * | 3/1969 | Eichholz | D06F 58/14 223/51 |
| 3,905,125 | A * | 9/1975 | Hubner | D06F 58/14 34/239 |
| 5,992,045 | A * | 11/1999 | Kellogg | F26B 25/18 34/103 |
| 9,725,838 | B1 * | 8/2017 | Ribeiro | D06F 37/02 |
| 2002/0053607 | A1 * | 5/2002 | Gaaloul | B05B 17/0615 239/302 |
| 2004/0093758 | A1 * | 5/2004 | Miller | A45D 20/18 34/201 |
| 2005/0257440 | A1 * | 11/2005 | Seiffert | D06F 73/02 52/79.1 |
| 2008/0222909 | A1 * | 9/2008 | Picozza | F26B 9/003 34/195 |
| 2008/0289210 | A1 * | 11/2008 | Mangano | D06F 58/14 34/239 |

* cited by examiner

PORTABLE WASHER AND DRYER

CROSS-REFERENCE TO RELATED APPLICATIONS

This application claims the benefit under 35 U.S.C. § 119(e) of U.S. Patent Application No. 62/802,272, entitled "PORTABLE WASHER AND DRYER," filed Feb. 7, 2019. The disclosure of the foregoing application is incorporated herein by reference in its entirety for all purposes.

BACKGROUND

The conventional washing machine and dryer are relatively large appliances. Each unit typically includes a rotating drum driven by an electric motor. The rotating drum provides a tumbling action for washing as well as for drying the clothes. The drying unit can also include an electrical heat source which produces hot air that passes over the clothes as the drum rotates. Such conventional appliances are usually permanently installed in a building and generally require a large amount of electricity to operate. These conventional appliances usually serve the purpose when large loads of clothing items are required to be washed and/or dried, as in typical households.

SUMMARY

This specification describes a portable apparatus for washing and drying clothes. This specification further describes a method of manufacturing a portable apparatus for washing and drying clothes.

In general, one innovative aspect of the subject matter described in this specification can be embodied in an apparatus for washing and drying clothes that includes a washing unit and a drying unit. The washing unit includes a washer top end and a washer bottom end, the washer top end including a securable cover that selectively covers and exposes an opening, a washing compartment having an inner layer extending between the top washer end to the bottom washer end of the washing unit, the inner layer including a plurality of washing grooves, the washing compartment configured to be collapsible, a water tube connected from the top washer end to the bottom washer end of the washing unit, a water hose extending from a side wall of the washing unit at a location that is closer to the top washer end than the bottom washer end of the washing unit, and a wringer coupled to an end of the washing compartment that is closer to the bottom washer end of the washing unit than the top washer end of the washing unit. The drying unit is coupled to the washing unit, the drying unit includes a top dryer end and a bottom dryer end, a first dryer side wall and a second dryer side wall, wherein the washing unit is configured to be coupled to the first dryer side wall of the drying unit, a drying compartment extending between a lower side of the top dryer end to an upper side of the bottom dryer end of the drying unit, a power compartment at the bottom dryer end and coupled to the drying compartment, a fan assembly at the top dryer end and coupled to the drying compartment, a heating assembly coupled to the second dryer side wall of the drying unit, and an air vent located in the second dryer side wall of the drying unit.

These and other aspects can each optionally include one or more of the following features.

In some implementations, a washer blade assembly is coupled to the washing compartment and connected to the top end and bottom end of the washing unit. In some implementations, the washer blade assembly includes a connector; a first washer blade, and a second washer blade operably coupled to the first washer blade via the connector. In some implementations, the washer blade assembly is made of a bendable material and configured to reduce size when a pressure is applied.

In some implementations, the heating assembly includes a plurality of heating bulbs. In some implementations, the drying unit further includes a drying baffle located in the drying compartment.

In some implementations, the power compartment includes at least one DC motor. In some implementations, the power compartment houses at least one DC motor and an AC/DC converter. In some implementations, the AC/DC converter is electrically connected to the heating assembly, DC motor, and fan assembly.

In some implementations, the washing unit further includes an air release device. In some implementations, the air release device includes an air release string configured to release air from the washing compartment after a user pulls the air release device outward from an air release receptacle. In some implementations, the fan assembly includes two or more fans.

In some implementations, a strap connected to the top end of the drying unit. In some implementations, the strap connected to the top end of the drying unit by a first connector and a second connector. In some implementations, the strap is adjustable for different lengths.

In some implementations, the washing compartment is configured to hold at least two gallons of water.

In some implementations, the water hose includes a water hose connector. In some implementations, the water hose connector is configured to connect to the threads of a resealable screw-top container. In some implementations, the water hose connector is adjustable to connect to a plurality of water sources.

In general, one innovative aspect of the subject matter described in this specification can be embodied in a method of manufacturing a portable apparatus for washing and drying clothes including connecting a securable cover that selectively shields and exposes an opening to a top washer end of a washing unit, inserting, into the washing unit, a washing compartment having an inner layer between the top washer end and a bottom end of the washing unit, the inner layer including a plurality of washing grooves, the washing compartment configured to be collapsible, connecting a water tube from the top end to the bottom end of the washing unit, connecting a water hose extending from a first side wall of the washing unit at a location that is closer to the top washer end than the bottom washer end of the washing unit, connecting a wringer to an end of the washing compartment that is closer to the bottom washer end of the washing unit than the top washer end of the washing unit, connecting a top dryer end and a bottom dryer end to a first dryer side wall of a drying unit, connecting a top dryer end and a bottom dryer end to a second side wall of the drying unit, inserting, into the drying unit, a drying compartment to a lower side of the top dryer end and an upper side of the bottom dryer end, connecting a power compartment at the bottom dryer end of the drying unit, connecting a fan assembly at the top dryer end of the drying unit, connecting a heating assembly to the second dryer side wall of the drying unit, and connecting an air vent to the second dryer side wall of the drying unit.

Some implementations include one or more of the following features. In some implementations, the method further includes connecting a second side wall of the washing unit to the first dryer side wall of the drying unit.

Particular embodiments of the subject matter described in this specification can be implemented to realize one or more of the following advantages. Utilizing a portable apparatus for washing and drying clothes that can be easily transportable allows a user, such as a traveler, the ability to wash and/or dry clothes quickly, without having to find washer and/or dryer appliances while traveling.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
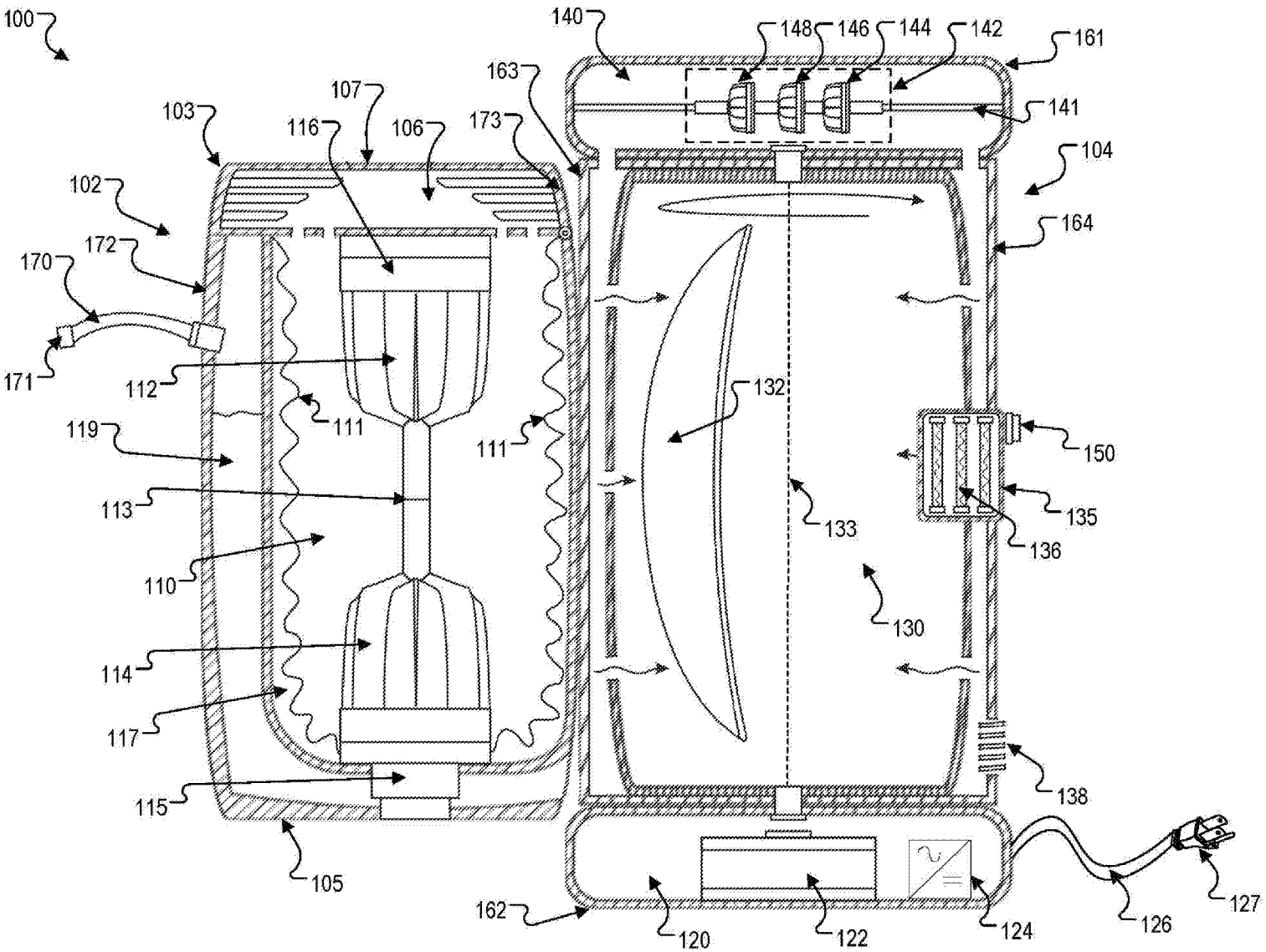
FIG. 1 illustrates a cross sectional view of an example portable apparatus for washing and drying articles of clothing.

People that travel, either for business or leisure, generally may not have access to washing appliances. However, they may still wish to wash and dry their clothes while they are away from their homes. The size of the laundry load is normally relatively small for travelers because there are only limited number of garments that are needed to be washed and/or dried. One option is to wash clothes by hand which can be very burdensome. Some places do offer laundry services for people that travel, but these can be cost prohibitive. Thus, people would appreciate a portable device which could be used for washing and drying clothes at an airport, bus stop, and the like. A portable washing and drying device can also be appreciated by mobile homes owners, studio apartments, or the like, which may not have dedicated laundry space to install large conventional washing and laundry appliances.

This document describes a portable apparatus for washing and/or drying clothes. This document further describes a method of manufacturing the portable apparatus for washing and drying clothes.

Many aspects of the subject matter described herein can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

Figure 2:
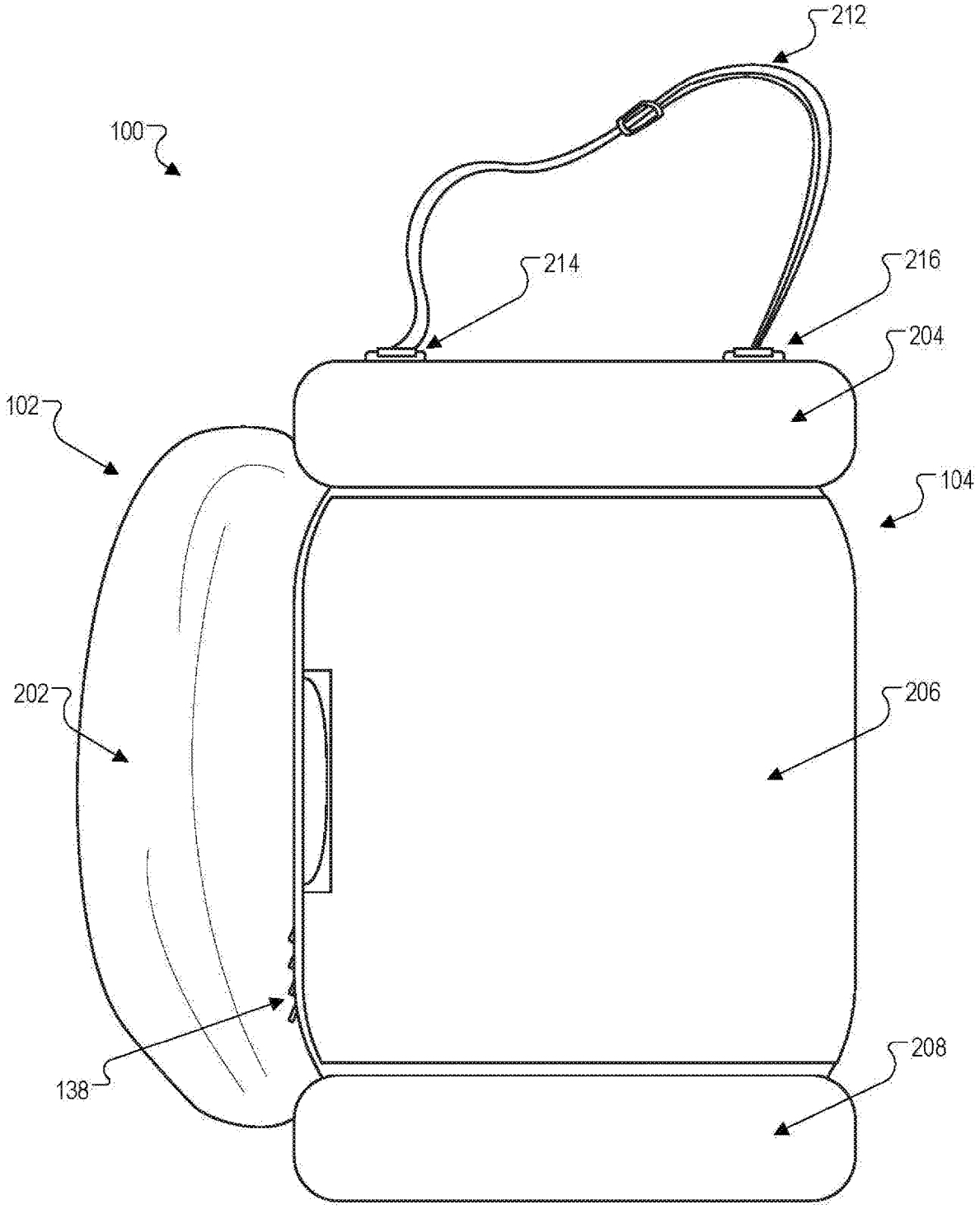
FIG. 2 illustrates a perspective view of an example portable apparatus for washing and drying articles of clothing.

FIG. 1 illustrates a cross sectional view of an example portable apparatus 100 for washing and drying articles of clothing. The apparatus 100, as shown, includes a washing unit 102 coupled to a drying unit 104. In some implementations, the apparatus 100 can include only the washing unit 102, only the drying unit 104, or the washing unit 102 and the drying unit 104 as separate and uncoupled units. For example the drying unit 104 and the washing unit 102 could be two separate devices, used to wash and/or dry articles of clothing separately, but then can be configured to be connected together by brackets, or other connecting means, in order to be easily transported, like a suitcase or bag, as shown in FIG. 2. In some implementations, as shown in FIG. 1, a second side wall 173 of the washing unit 102 is coupled to the first side wall 163 of the drying unit 104.

The washing unit 102 has a top end 103, a bottom end 105, a first side wall 172, and a second side wall 173. The washing unit 102 includes an opening 106 that can be covered by a securable top 107 at the top end 103, and a wringer 115 at the bottom end 105. The washing unit 102 includes a washing compartment 110 that has an inner wall 117 extending between the top end 103 to the bottom end 105 of the washing unit 102.

According to some embodiments, the inner wall 117 includes a plurality of washing grooves 111. The washing grooves 111 provide a rutted surface such that articles of clothing, when pressure is applied, can be scrubbed and washed as they are rubbed against the washing grooves 111. Alternatively, the washing grooves 111 may be incorporated as a particular material of the inner wall 117 in the washing compartment 110. For example, the material could be a flexible plastic that is coarse, or includes several bumps or grooves that would also scrub an article of clothing when pressure is applied.

The washing unit 102 includes a water tube 119 and a water hose 170 connected to the water tube 119 near the top end 103 coupled to the first side wall 172. As shown, the water tube 119 is outside of the washing compartment 110 and extends from the top end 103 to the bottom end 105 of the washing unit 102. The water tube 119 is configured to supply water to and from the washing compartment 110. The water hose 170 is used to supply clean water to the washing unit 102 (e.g., as shown and further described with reference to FIG. 3). Additionally, when the washing unit is turned upside down, the water hose 170 is used to empty water in the washing unit (e.g., as shown and further described with reference to FIG. 6).

The water hose 170 can include a water hose connector 171 that is configured to connect to threads of a sink or faucet. Additionally, or alternatively, the water hose connector 171 can be configured to connect to threads of an extension hose (not shown) that allows a user more flexibility to attach the water hose 170 to a sink or water source further away.

In some implementations, the water hose connector 171 is configured to connect to threads of a resealable screw-top container. For example, a 2-liter bottle can be screwed to the water hose connector and be used for filling up the water tube 119 and/or the washing compartment 110. Additionally, or alternatively, the dirty water after washing the articles of clothing can be emptied into an empty 2-liter bottle. When connected to a resealable screw-top container, spillage of water, especially the dirty and soapy water after washing cycle, can be reduced.

The washing compartment 110 further includes a washer blade assembly 116 that extends between the top end 103 and the bottom end 105 of the washing unit 102. The washer blade assembly 116 includes a first washer blade 112 and a second washer blade 114 coupled to the first washer blade by a connector 113. In some implementations, the washer blade assembly 116 is made of a collapsible material that allows the washer blade assembly 116 to collapse when squeezed or compressed by a user. The collapsible material can be foam, a sponge-like material, or some types of compressible plastic. Materials such as HDPE, PVA compound sponges, paper or cardboard wicks or filters, or even fabric material may be used. Alternatively, the washer blade assembly 116 can be made of a more rigid material that would not collapse when squeezed by a user.

In some implementations, the washer blade assembly 116 is a fixed component (e.g., not designed to rotate about an axis). When the washer blade assembly 116 is a fixed component, the user can move articles of clothing around the washer blade assembly 116 rather than rotating the washer blade assembly 116 itself.

Alternatively, the washer blade assembly 116 can be a rotatable component that is capable of being rotated about an axis (e.g., a vertical axis) that extends through the top end 103 and the bottom end 105. When the washer blade assembly 116 is a rotatable component, the articles of clothing can be scrubbed and washed, by both of the washer blade assembly 116 and the washing grooves 111, as the user grabs and squeezes the washing compartment. More specifically, when the users grabs and squeezes the washing component, the articles of clothing are moved around the washer blade assembly 116 creating a scrubbing action. This will be further described herein with reference to FIG. 4. These and other features and processes of using the washing unit 102 as described in FIG. 1 are further described below with reference to FIGS. 3-6.

The drying unit 104 has a top end 161, a bottom end 162, a first side wall 163, and a second side wall 164. As shown, the washing unit 102 is coupled to the first side wall 163 of the drying unit 104. The drying unit 104 includes a fan compartment 140 at the top end 161, a power compartment 120 at the bottom end 162, and a heating assembly 135 and an air vent 138 coupled to the second side wall 164. However, the specific locations of these components can be different than the specific configuration shown in FIG. 1. In other words, different configurations can be used for the locations of the fan compartment 140, power compartment 120, heating assembly 135, the air vent 138, and so forth.

The drying unit 104 includes a heating compartment 130 extending between a lower side of the top end 161 and an upper side of the bottom end 162. In some implementations, the drying unit 104 includes a drying baffle 132 located in the heating compartment 130. The drying baffle 132 is configured to rotate about an axis 133 that extends between a center of the lower side of the top end 161 and a center of the upper side of the bottom end 162. The rotation of the baffle provides a function of tumbling articles of clothing to aide in a drying process.

In some implementations, the drying unit 104 includes heating assembly 135 that includes heating bulbs 136. Further, as shown in FIG. 1, the drying unit 104 includes a power switch 150 coupled to the heating assembly 135. Alternatively, the power switch 150 can be located anywhere accessible by a user on the outside of the drying unit 104, or connected to the drying unit 104 by a power cord. The power switch 150 can be provided in many different forms, such as a toggle switch, electronic push button, heat-sensitive button, slide switch, and so on.

In some implementations, the drying baffle 132 is powered by a direct current (DC) motor 122 housed in the power compartment 120. As shown, the power compartment 120 includes the DC motor 122 and an AC/DC converter 124. The AC/DC converter 124 is configured to be connected to a standard AC power source (e.g., 120 volts at 60 Hz frequency) by the electrical cable 126 and plug adapter 127. The AC/DC converter 124 can also supply power to the heating assembly 135 and fan compartment 140. Alternatively, the power compartment 120 could include a DC battery in lieu of, or in addition to, the AC/DC converter 124. For example, the DC battery can be a rechargeable battery that can be charged by the standard AC power source. Other self-contained power sources that can be used include alkaline batteries, lead acid batteries, solar power cells, Ni-Cad batteries, lithium batteries, or the like. The electrical components of the drying unit 104 are further described herein with reference to FIG. 9.

The fan compartment 140 includes a fan assembly 142. The fan assembly 142 includes fans 144, 146, and 148. Alternatively, the fan assembly 142 can include a different number of fans, or even one fan. The fan assembly 142 is configured to rotate about an axis 141 (e.g., a horizontal axis) extending between the first side wall 163 and the second side wall 164 of the drying unit 104, and circulate air within the drying unit 104 during operation. The circulated air is vented through the air vent 138. The operation of the fan assembly 142 and the air circulation within the drying unit 104, is further described herein with reference to FIGS. 7-8. These and other features and processes of using the drying unit 104 as described in FIG. 1 are further described below with reference to FIGS. 7-11.

FIG. 2 illustrates a perspective view of the example portable apparatus 100 for washing and drying articles of clothing. As shown, the exterior of the portable apparatus 100 includes the washing unit 102 coupled to the drying unit 104. The exterior of the washing unit 102 is a washer bag pouch 202. As described herein, a flexible washer bag pouch 202 is used, as opposed to a hard surface, so that a user can squeeze and manipulate articles of clothing located within the washing unit 102 during a washing operation as described herein with reference to FIG. 4.

The exterior of the drying unit 104 includes a top exterior portion 204, a middle exterior portion 206, and a bottom exterior portion 208. The exterior portions 204, 206, and 208 may be made of suitable high strength materials to withstand forces and stresses imparted from various angles and positions during the drying operation of the apparatus 100 and as the apparatus 100 travels through different conditions. The selected material may further be lightweight so that the apparatus 100 may still be easily transportable. In some embodiments, the exterior portions 204, 206, and 208 may be made of carbon fiber materials.

In some embodiments, and as illustrated in FIG. 2, the portable apparatus 100 includes a carrying strap 212 attached to the top exterior portion 204 of the drying unit 104 by fasteners 214 and 216. Additionally, or alternatively, the portable apparatus 100 includes a handle. Alternatively, the portable apparatus 100 includes an adjustable telescoping handle at the top exterior portion 204 and wheels at the bottom exterior portion 208, and operates similar to a suitcase.

The features and processes of using the washing unit 102 as described in FIG. 1 are now described below with reference to FIGS. 3-6.

Figure 3:
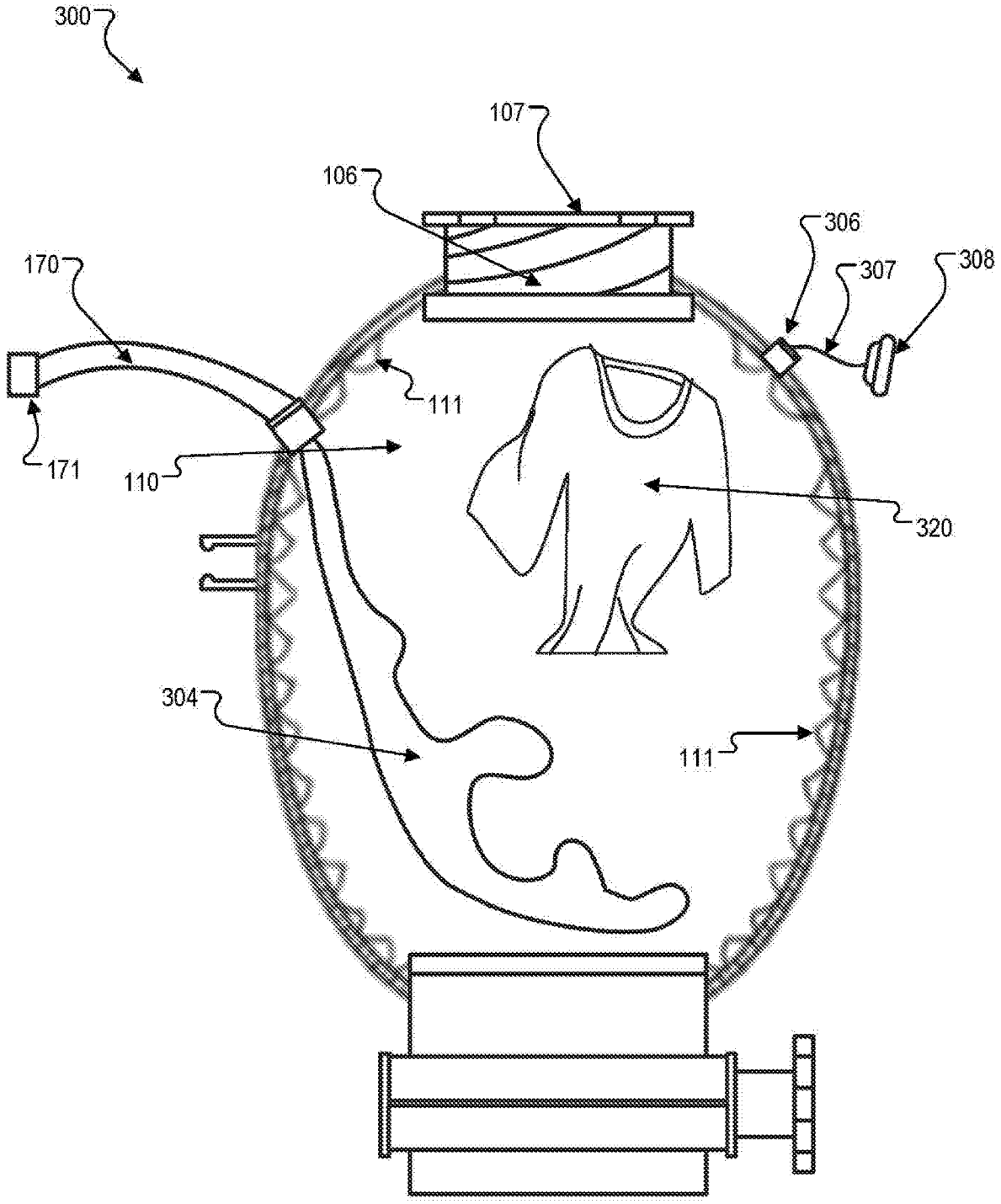
FIG. 3 illustrates a cross sectional view of an example environment of washing an article of clothing with an example washing unit.

FIG. 3 is an example illustration 300 an article of clothing being washed with an example washing unit, such as washing unit 102. In particular the item 320 is placed by a user into the washing compartment 110 through the opening 106 by opening the top 107. Then a user can initiate the washing process by adding water 304 to the washing compartment of the washing unit 102. Additionally, a user can optionally add detergent through the opening 106 when the user placed item 320 in the washing unit 102. The amount of water can vary since the washing compartment 110 does not need to be filled completely. In some embodiments, a user may be instructed to fill the washing compartment 110 half full (or some other appropriate level). For example, the washing compartment 110 may be configured to hold four liters, thus, a user can use a standard 2-liter bottle to correctly fill the washing compartment 110 half full of water. Alternatively, the washing compartment 110 may be configured to hold two liters, thus, a user can use a standard 1-liter bottle.

Figure 4:
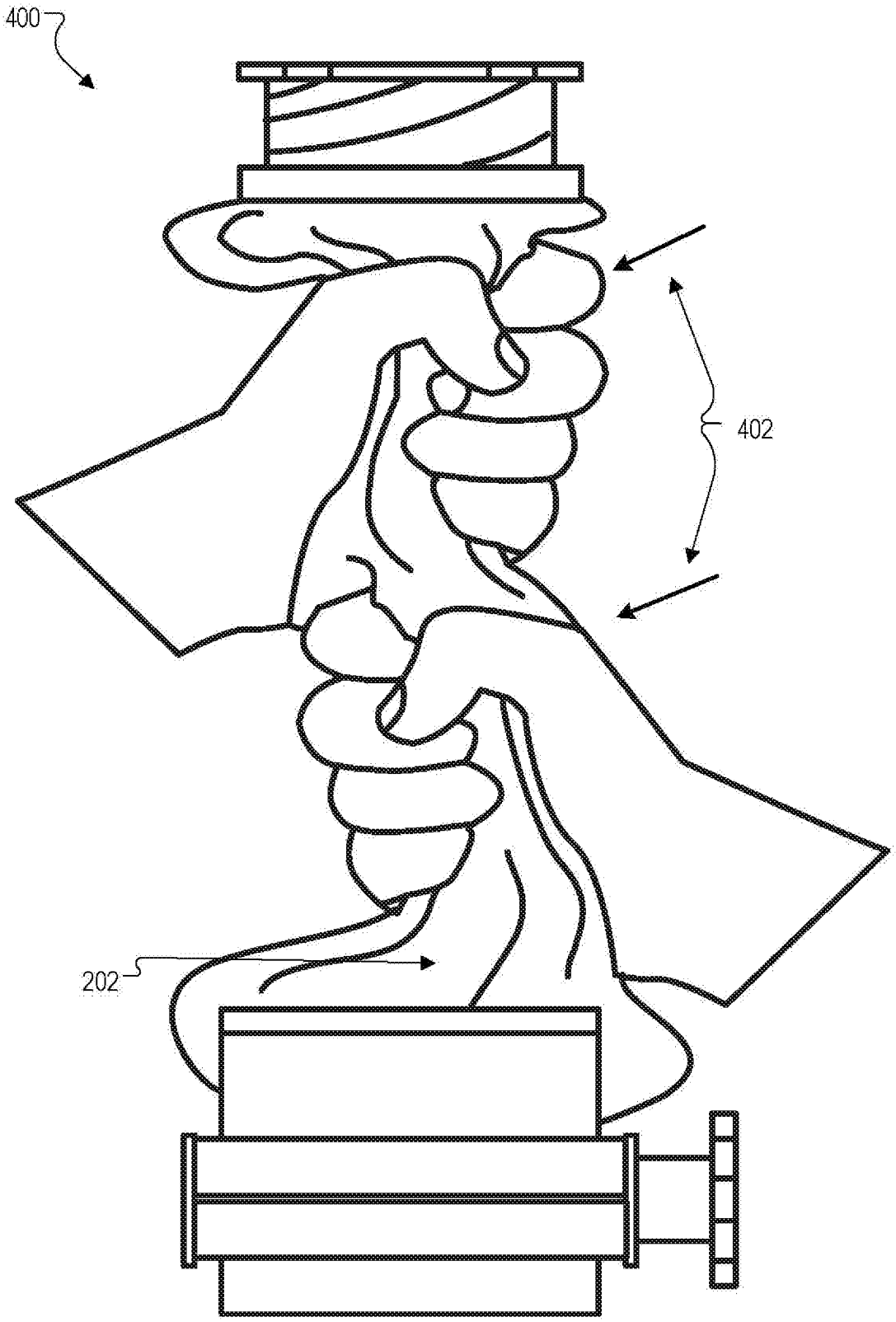
FIG. 4 illustrates an example environment of using an example washing unit for washing articles of clothing.

When the user is ready to scrub the clothes by squeezing on the washer bag pouch 202 of the washing unit 102, as illustrated in FIG. 4, air pressure may need to be reduced. To reduce the air pressure, the washing unit 102 includes air release device 308 (also considered a plug) to reduce the air pressure to allow the washer bag pouch 202 to shrink around the articles of clothing. As shown in FIG. 3, the air release device 308 has been pulled out of the air release receptacle 306, so that air can be released out of the washing compartment 110. The air release device can stay connected to the air release receptacle 306 by the air release string 307 to reduce the chance a user may lose the air release device 308. Alternatively, other types of plugs or air release devices may be utilized to reduce the air pressure.

FIG. 4 is an example illustration 400 of using an example washing unit, such as washing unit 102, for washing articles of clothing. As shown, the user has released the air pressure and is squeezing or compressing the washer bag pouch 202 by the user's hands 402. Assuming clothing is inside the washing unit 102, the clothing is being scrubbed against the inner wall 117 of the washing compartment 110 because of the squeezing or compression. If this particular washing unit 102 includes a washer blade assembly 116, then it can be assumed the washer blade assembly is made of a flexible material, as discussed previously, allowing the washer blade assembly 116 to be compressed with the user's actions. Additionally, or alternatively, if the inner wall 117 includes the plurality of washing grooves 111, as the user's hands 402 compress the washer bag pouch 202, the articles of clothing are being scrubbed with each compression as the washing grooves 111 are placed in contact with the clothing.

Figure 5:
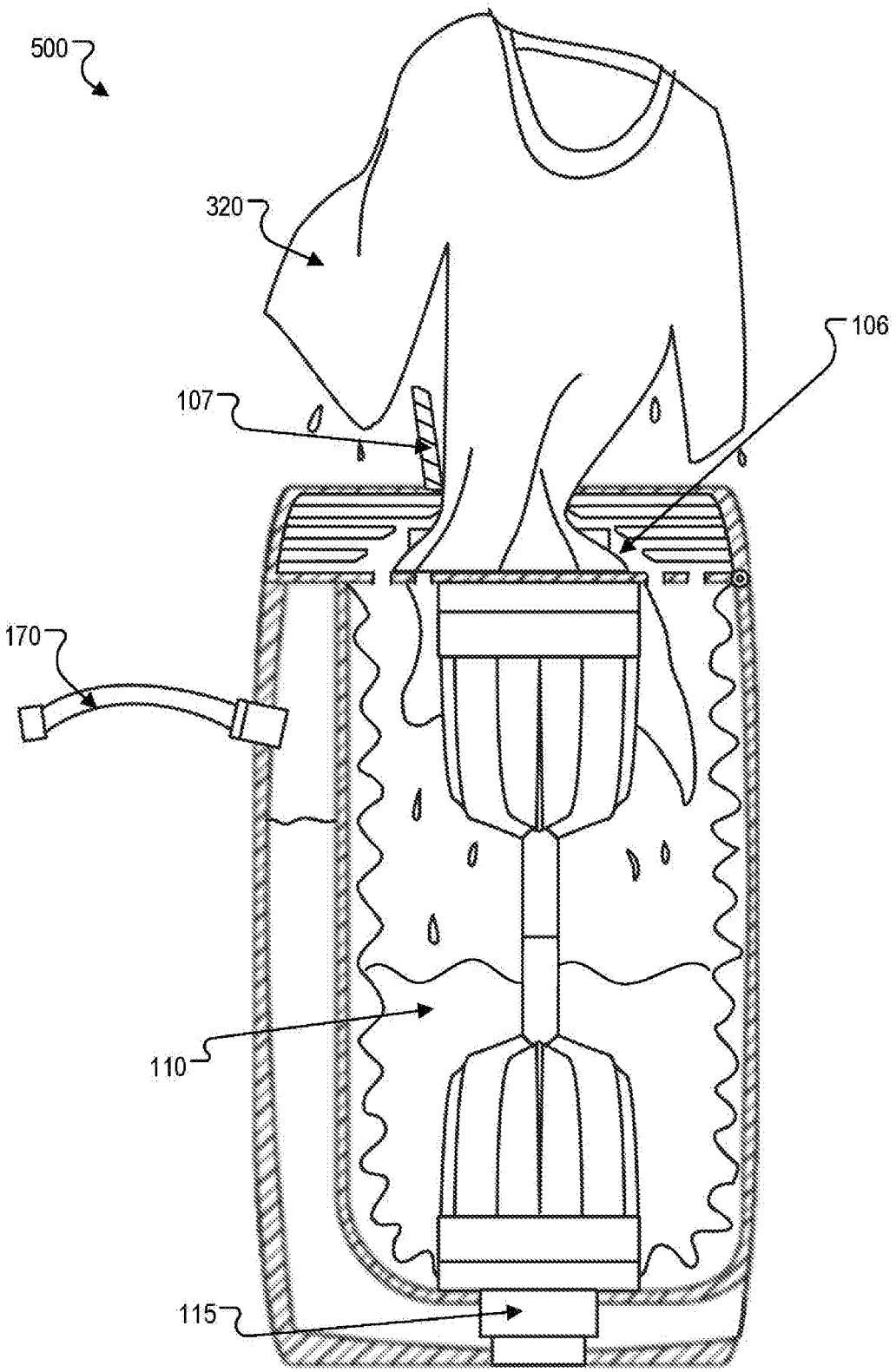
FIG. 5 illustrates an in use cross sectional view of an example washing unit.

FIG. 5 is an example illustration 500 an example washing unit, such as washing unit 102, being used for washing articles of clothing. In particular, the illustration 500 shows item 320 being removed from the washing compartment 110 of the washing unit 102 through opening 106. As shown, the securable top 107 is in an open position so the user can remove and/or add clothes to the washing compartment 110. It should be assumed that the illustration 500 is depicting the washing unit 102 and item 320 following a user compressing the washer bag pouch 202, as illustrated in FIG. 4, to scrub and wash item 320. Thus, the illustration 500 of FIG. 5 depicts a user removing a saturated article of clothing in order to prepare for the next step of squeegeeing out the water and removing the dirty and/or soapy water. Squeegeeing out the water can be performed using the wringer 115, as will be further described below with reference to FIG. 6. Additionally, or alternatively, the squeegeeing can be done manually by the user to remove as much water from the item 320 as possible.

Figure 6:
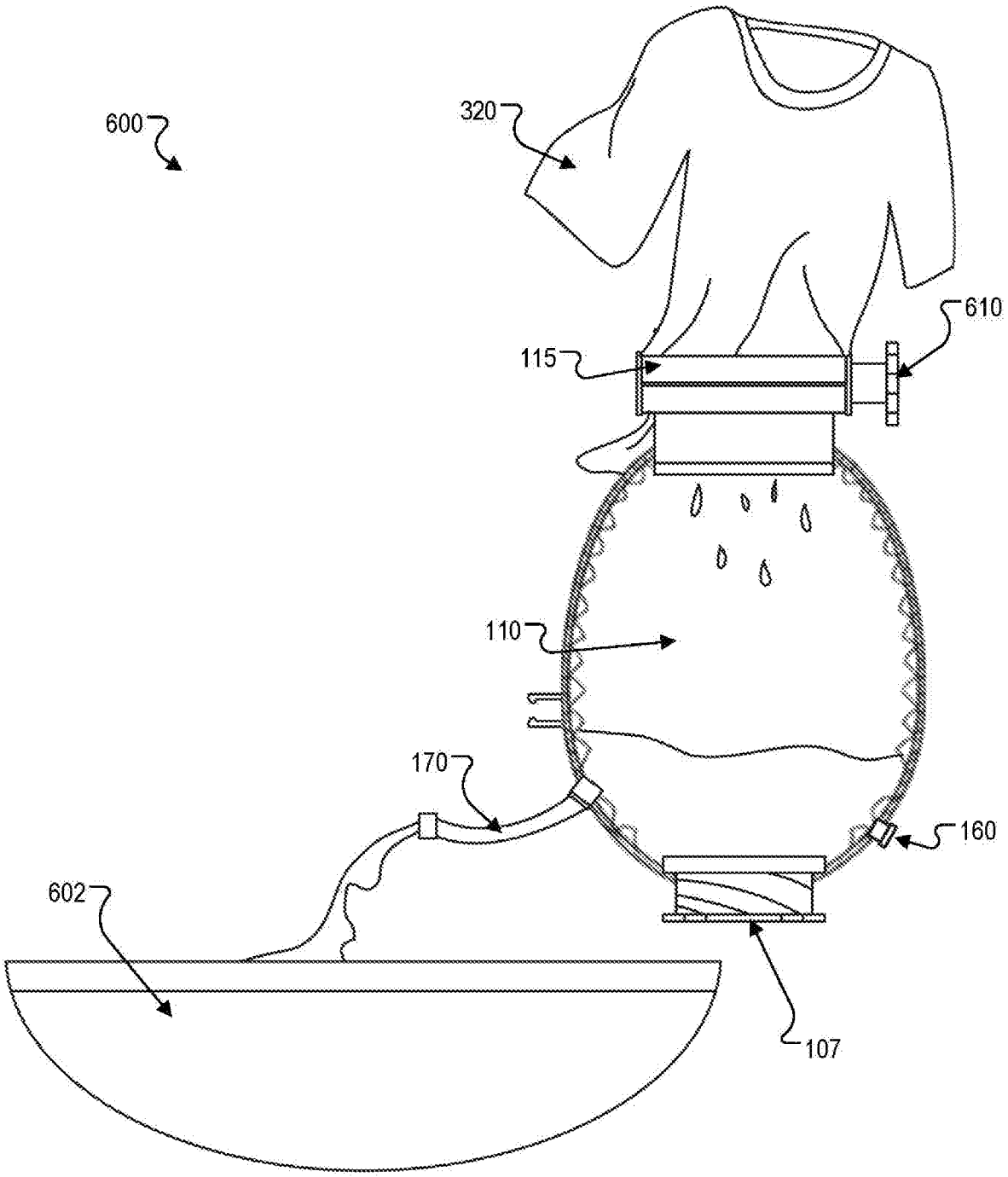
FIG. 6 illustrates an in use cross sectional view of an example washing unit.

FIG. 6 is an example illustration of a cross sectional view of an example washing unit, such as washing unit 102, for washing articles of clothing. In particular, FIG. 6 illustrates squeegeeing out water from item 320 using the wringer 115, and draining the dirty and/or soapy water out of the washing compartment. It should be noted that the washing unit 102 is now flipped over 180° in order to drain the water. The water hose 170 is at the bottom to release the water, and the wringer 115 is at the top of the washing unit. The wringer 115 includes a turning handle 610. The turning handle 610 can be cranked or turned by a user to operate the wringer 115 as a person feeds the item 320 into the wringer 115. As shown, water is squeegeed out of the item 320 into the washing compartment 110. A user can drain the water in the washing compartment 110 through the water hose 170 and into a sink 602. Alternatively, a user can drain the water into a screw-top container and either dispose of the container, or dump the water to a suitable place for dumping dirty and/or soapy water, such as a sink, toilet, outside ground, and the like. Additionally, a user could attach an extension hose to the water hose 170 via the water hose connector 171 to extend the reach of the water hose 170 to avoid spillage.

The features and processes of using the drying unit 104 as described in FIG. 1 are now described below with reference to FIGS. 7-11.

Figure 7:
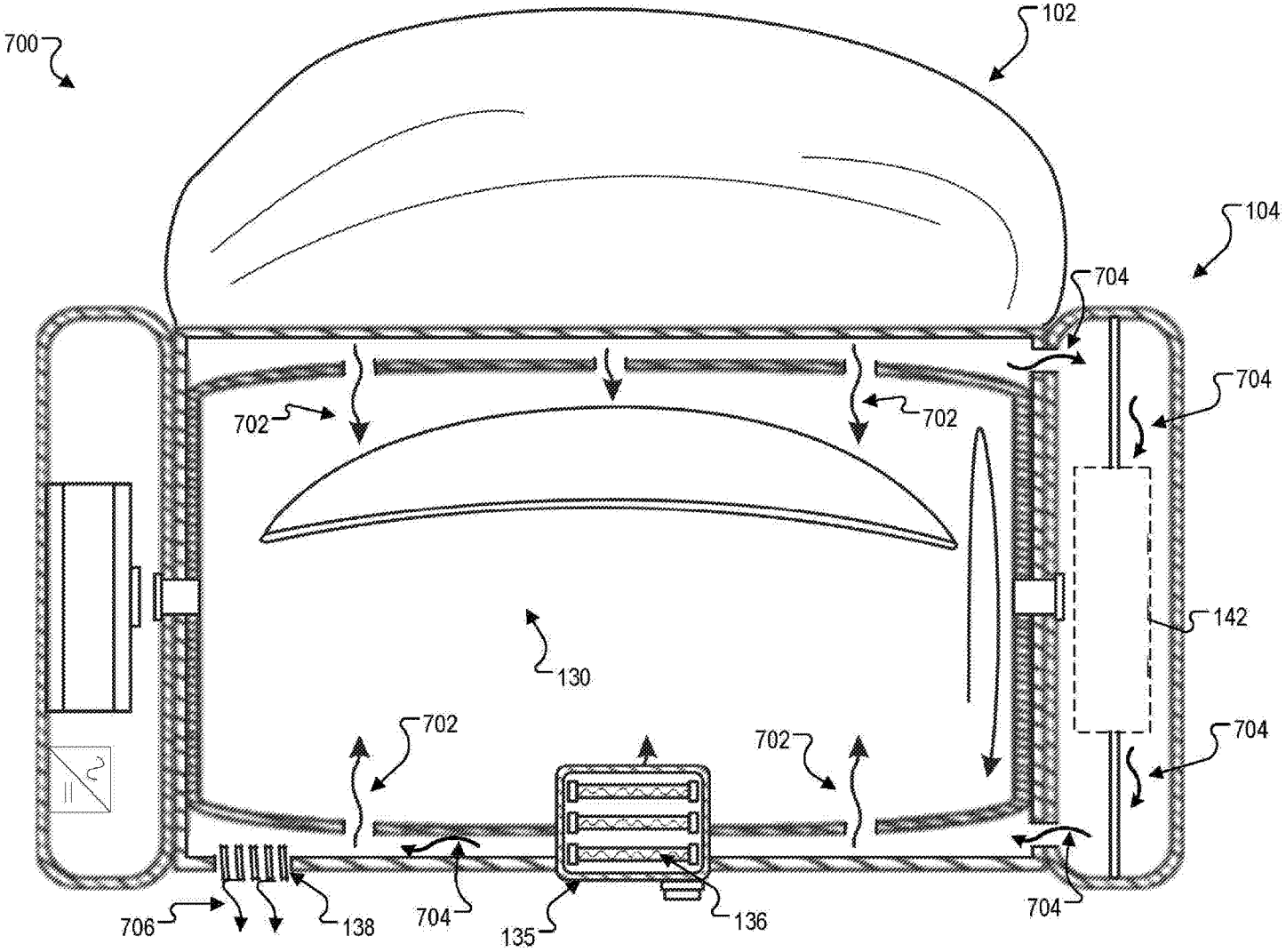
FIG. 7 illustrates a cross sectional view of an example drying unit.

FIG. 7 is an example illustration 700 of an example drying unit, such as drying unit 104, for drying articles of clothing. In particular, the illustration 700 depicts the different air flows created by some of the components in the heating unit 104, such as the heating assembly 135, the fan assembly 142, and the air vent 138. For example, heating air flows 702 are created by the heating bulbs 136 in the heating assembly 135, and heating air flows 702 are dispersed throughout the heating compartment 130. Air flows 704 are propagated throughout the heating compartment 130 by the fan assembly 142. Exit air flows 706 are vented out of the heating compartment 130 through the vent 138.

Figure 8:
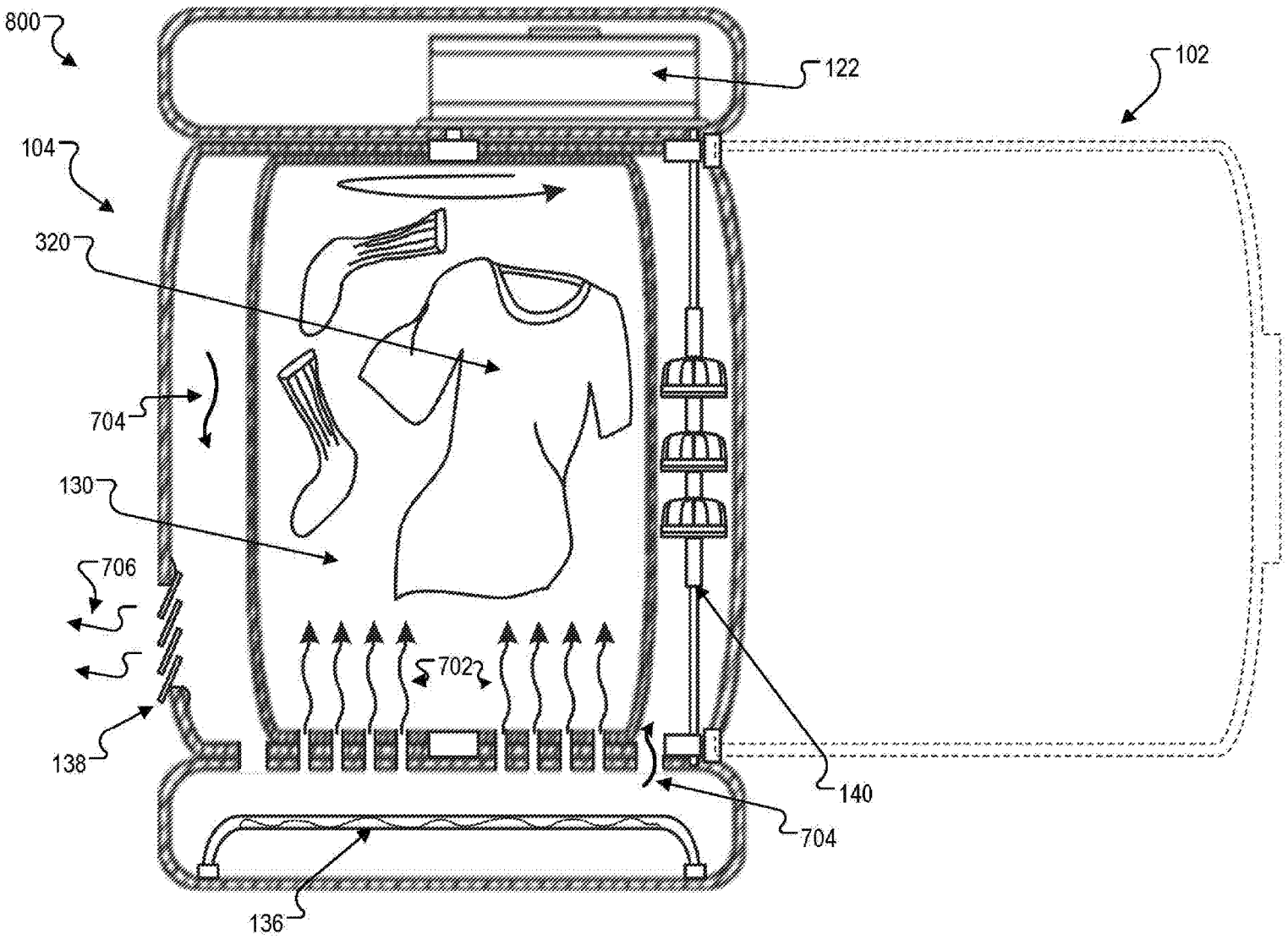
FIG. 8 illustrates an in use cross sectional view of an example drying unit.

FIG. 8 is an illustration 800 an example drying unit, such as drying unit 104, for drying articles of clothing. In particular, the illustration 800 depicts a different cross sectional perspective than the illustration 700 in order to show how the heat air flows 702 created by the heating bulb 136 are dispersed throughout the heating compartment 130. In some implementations, a baffle, such as drying baffle 132, although not shown in FIG. 8, is used to circulate the clothes, such as item 320, throughout the heating compartment 130. Alternatively, a baffle is not used, and the clothes are dried by the air flows 704, and heating air flows 702.

Figure 9:
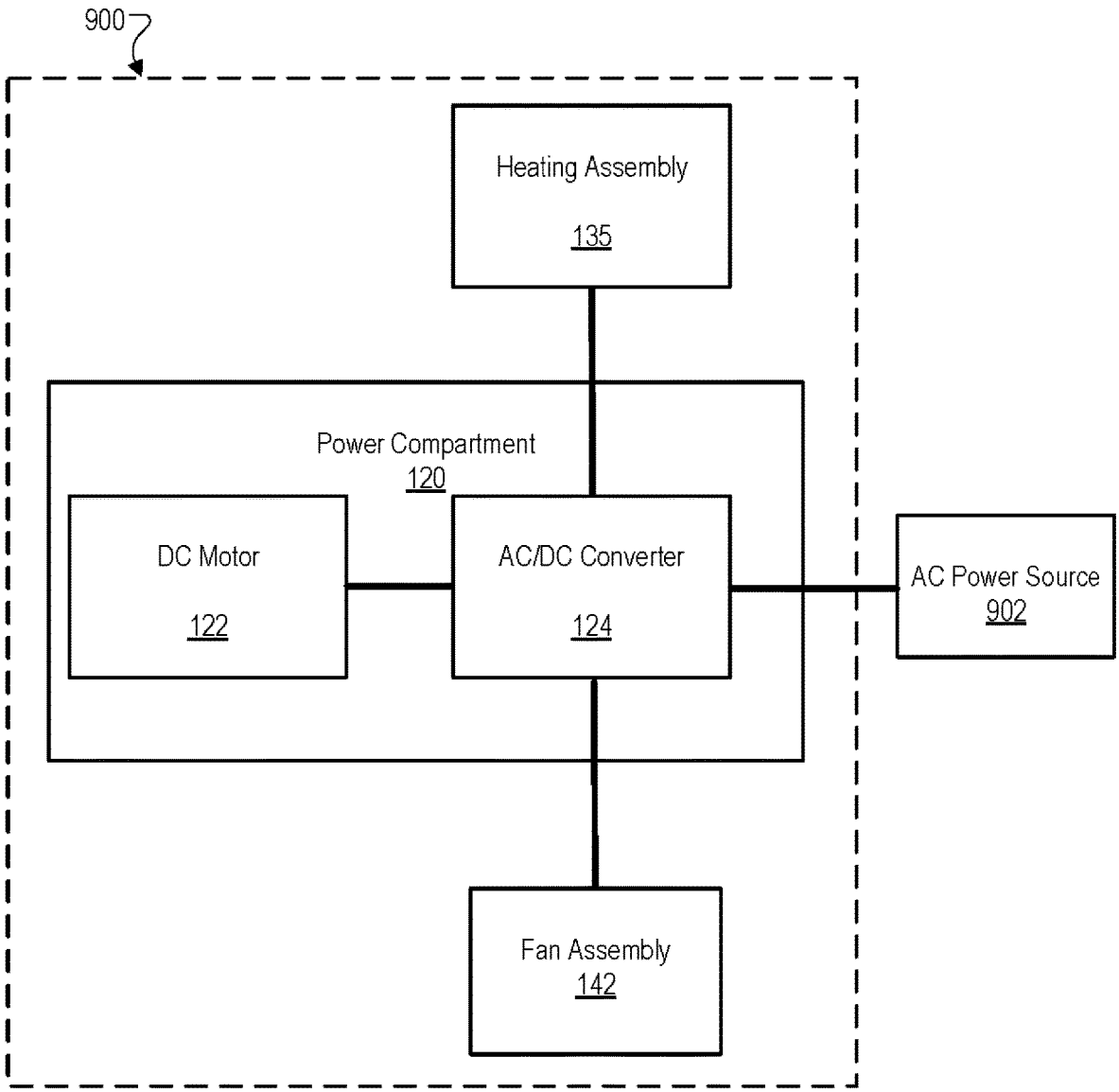
FIG. 9 is a block diagram of electrical components for an example drying unit.

FIG. 9 is a block diagram of electrical components for an example drying unit 900, such as drying unit 104, for drying articles of clothing. As shown in FIG. 9, the drying unit 900 includes the AC/DC converter 124 connected to AC power source 902. The AC/DC converter converts AC power from AC power source 902 to DC power. The AC/DC converter 124 provides DC power to the DC motor 122, where both the AC/DC converter 124 and the DC motor 122 are housed within the power compartment 120. The AC/DC converter 124 further provides DC power to the heating assembly 135 and the fan assembly 142.

Figure 10:
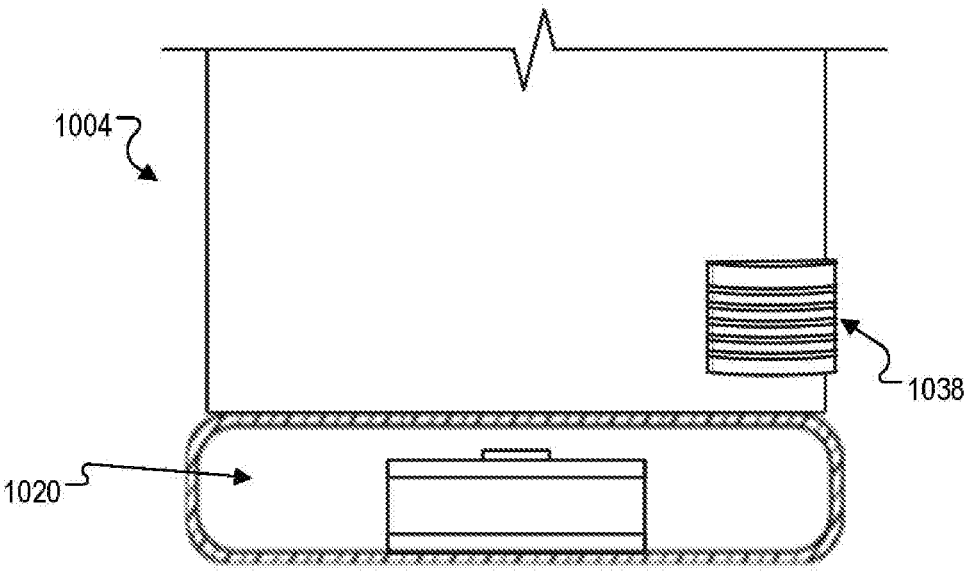
FIG. 10 illustrates a cross sectional view of an example drying unit.

FIG. 10 illustrates a cross sectional view of an example drying unit 1004 for drying articles of clothing. In particular, FIG. 10 shows a bottom portion of drying unit 1004 with power compartment 1020 and air vent 1038. Drying unit 1004 is similar to drying unit 104 as described in FIG. 1, however, drying unit 1004 does not including a heating assembly. Thus, during operation, articles of clothing would be dried by a fan assembly (not shown) circulating the air and being vented through the air vent 1038 to air dry the articles of clothing.

Figure 11:
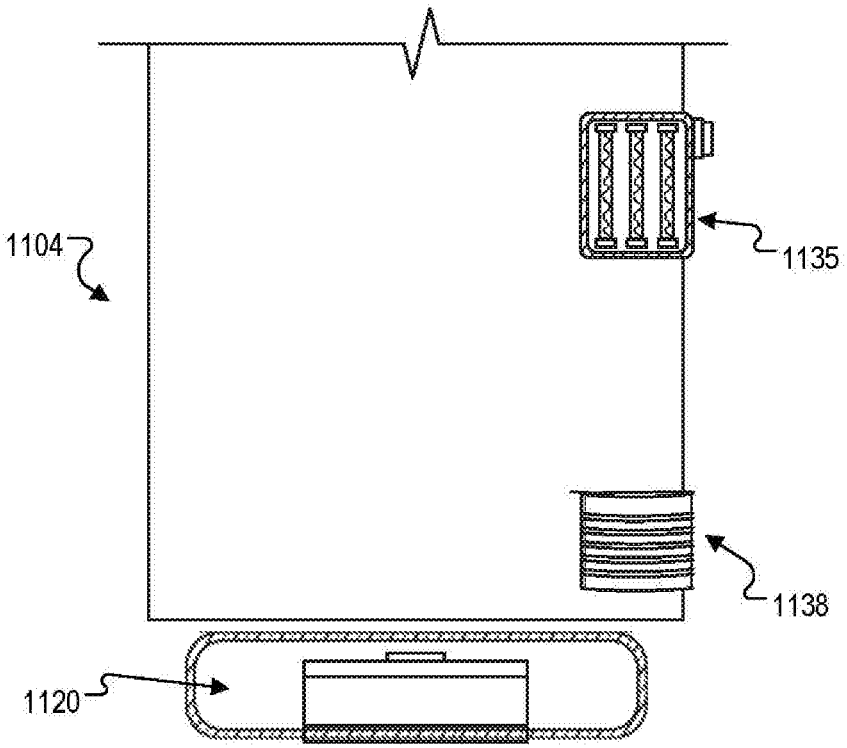
FIG. 11 illustrates a cross sectional view of an example drying unit.

FIG. 11 illustrates a cross sectional view of an example drying unit 1104 for drying articles of clothing. In particular, FIG. 11 shows a bottom portion of drying unit 1104 with power compartment 1120, air vent 1138, and heating assembly 1135. Drying unit 1104 is similar to drying unit 104 as described above, however, drying unit 1104 does not include a baffle for a function of tumbling articles of clothing. Thus, during operation, drying unit 1104 relies on the air flows from the air vent 1138, heating assembly 1135, and the fan assembly (not shown) to dry the articles of clothing.

Figure 12:
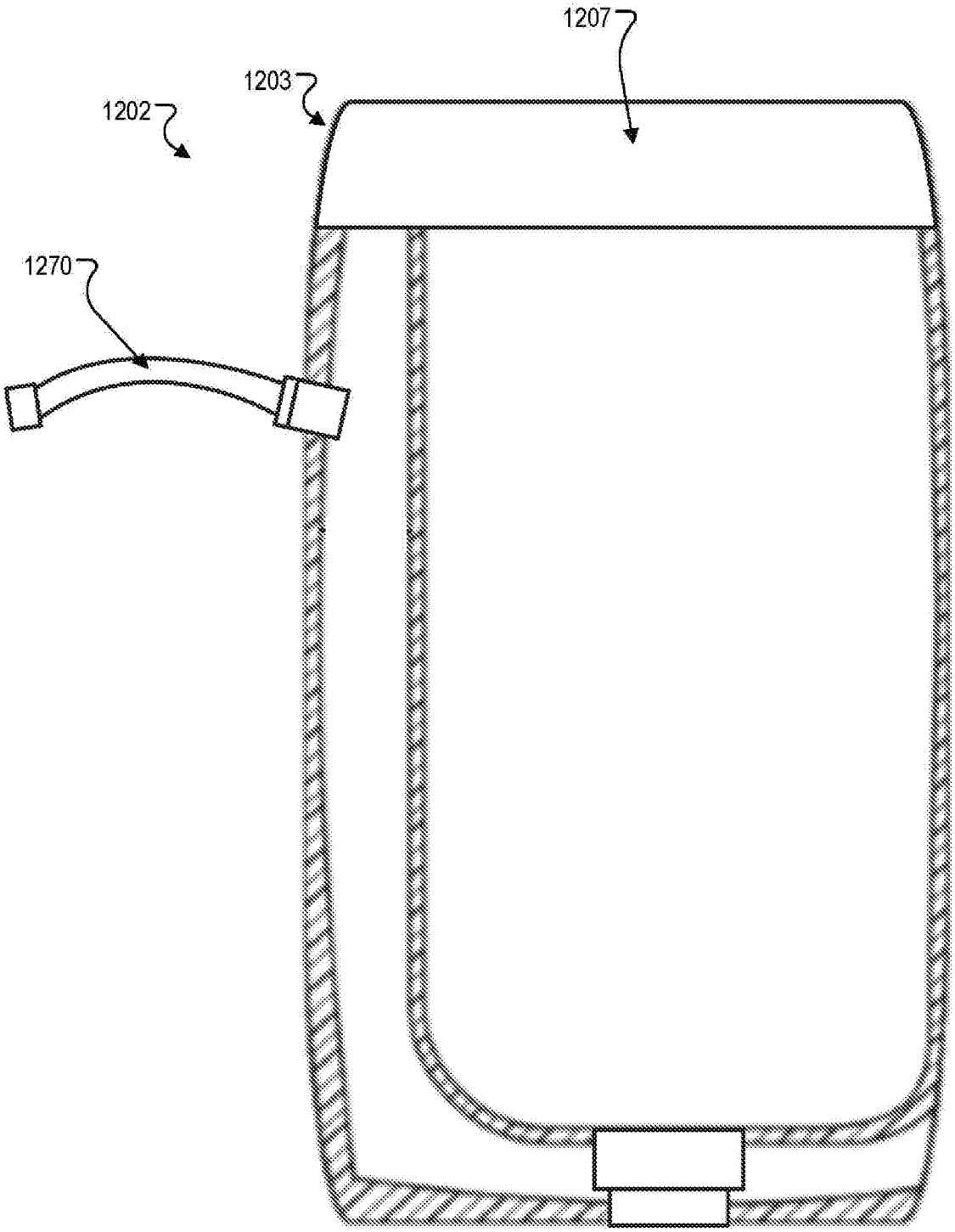
FIG. 12 illustrates a cross sectional view of an example washing unit.

FIG. 12 illustrates a cross sectional view of an example washing unit 1202 for washing articles of clothing. In particular, washing unit 1202 is shown with top end 1203 with a sealable lid 1207 configured to be opened and closed by a user. In this exemplary embodiment, the entire lid 1207 can be removed. For example, the lid 1207 can be twisted off along groves on the top end 1203 of the washing unit 1202 (not shown). Additionally, or alternatively, the lid 1207 can be opened by a hinge (not shown).

Figure 13:
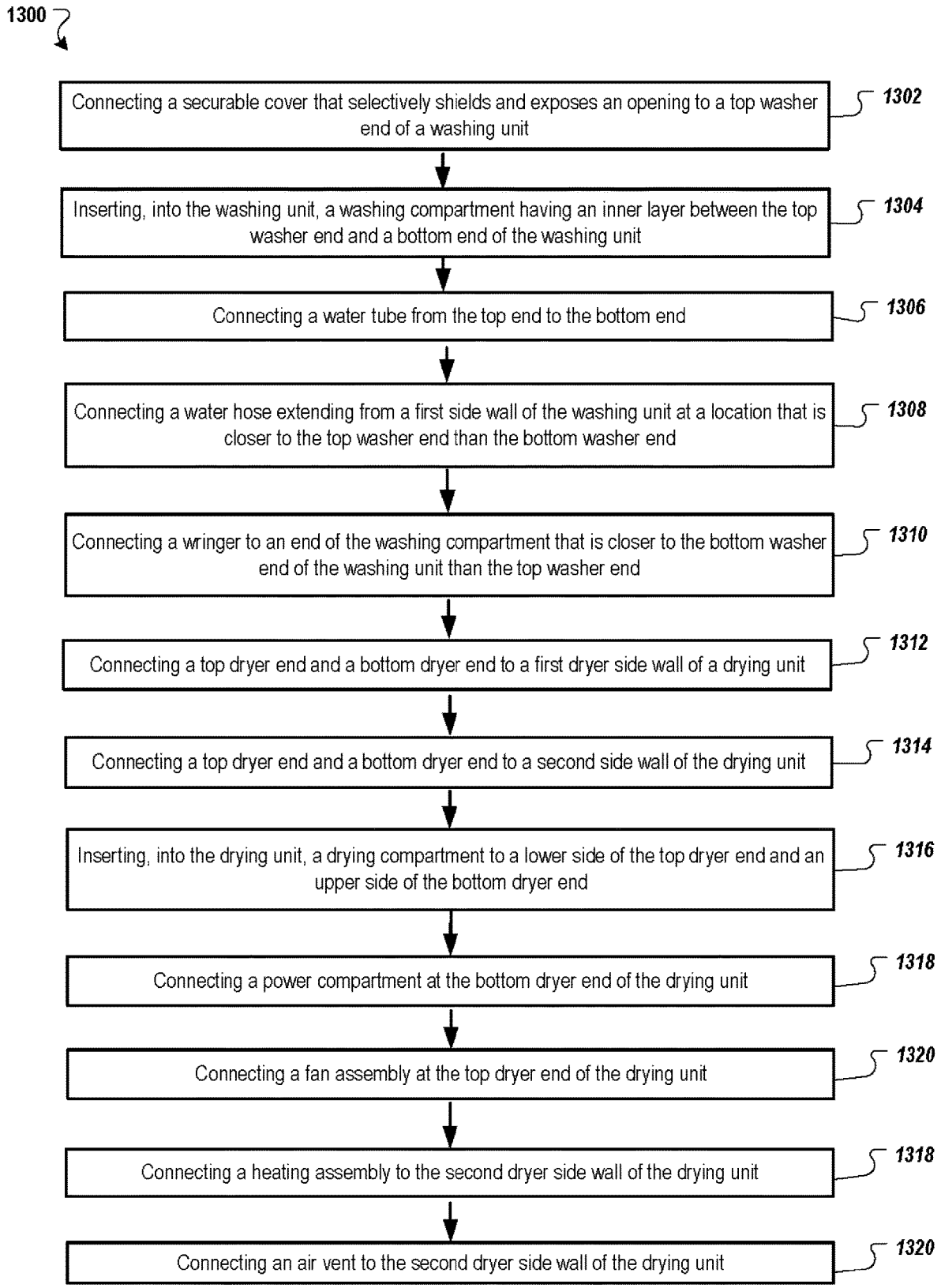
FIG. 13 is a flow diagram describing a process for manufacturing a portable apparatus for washing and drying clothes.

FIG. 13 is a flow diagram describing a process 1300 for manufacturing a portable apparatus for washing and drying clothes. The process 1300 includes connecting a securable cover that selectively shields and exposes an opening to a top washer end of a washing unit (1302). For example, as shown in FIG. 1, securable top 107 is connected to the top end 103 of the washing unit 102.

The process 1300 further includes inserting, into the washing unit, a washing compartment having an inner layer between the top washer end and a bottom end of the washing unit, (1304). For example, as shown in FIG. 1, the washing unit 102 includes a washing compartment 110 that has an inner wall 17 extending between the top end 103 to the bottom end 105 of the washing unit 102. In some implementations, the inner layer includes a plurality of washing grooves. For example, the inner wall 117 includes a plurality of washing grooves 111 that provide a rutted surface such that articles of clothing, when pressure is applied, can be scrubbed and washed as they are rubbed against the washing grooves 111. In some implementations, the washing compartment configured to be collapsible. For example, the components in the washing unit 102 can be made of a collapsible material that allows the components to collapse when squeezed or compressed by a user. The collapsible material can be foam, a sponge-like material, or some types of compressible plastic.

The process 1300 further includes connecting a water tube from the top end to the bottom end of the washing unit (1306). For example, as shown in FIG. 1, the washing unit 102 includes a water tube 119 and a water hose 170 connected to the water tube 119 near the top end 103 of the washing unit 102. In some implementations, the water tube 119 is outside of the washing compartment 110 and extends from the top end 103 to the bottom end 105 of the washing unit 102. In some implementations, the water tube 119 is configured to supply water to and from the washing compartment 110.

The process 1300 further includes connecting a water hose extending from a first side wall of the washing unit at a location that is closer to the top washer end than the bottom washer end of the washing unit (1308). For example, as shown in FIG. 1, the washing unit 102 includes a first side wall 172 and a second side wall 173, where a water hose 170 can be connected to the water tube 119 near the top end 103 and coupled to the first side wall 172 of the washing unit 102. The water hose 170 is used to supply clean water to the washing unit 102 (e.g., as shown and further described with reference to FIG. 3). In some implementations, when the washing unit is turned upside down, the water hose 170 is used to empty water in the washing unit (e.g., as shown and further described with reference to FIG. 6). In some implementations, the water hose 170 can include a water hose connector 171 that is configured to connect to threads of a sink or faucet. Additionally, or alternatively, the water hose connector 171 can be configured to connect to threads of an extension hose (not shown) that allows a user more flexibility to attach the water hose 170 to a sink or water source further away.

The process 1300 further includes connecting a wringer to an end of the washing compartment that is closer to the bottom washer end of the washing unit than the top washer end of the washing unit (1310). For example, as shown in FIG. 6, the washing unit 102 includes a wringer 115 near the bottom end 105 of the washing unit 102. In particular, FIG. 6 illustrates squeegeeing out water from item 320 using the wringer 115, and draining the dirty and/or soapy water out of the washing compartment. It should be noted that the washing unit 102 is now flipped over 180° in order to drain the water. In some implementations, the water hose 170 is at the bottom to release the water, and the wringer 115 is at the top of the washing unit. In some implementations, the wringer 115 includes a turning handle 610. For example, the turning handle 610 can be cranked or turned by a user to operate the wringer 115 as a person feeds the item 320 into the wringer 115. As shown in FIG. 6, water is squeegeed out of the item 320 into the washing compartment 110.

The process 1300 further includes connecting a top dryer end and a bottom dryer end to a first dryer side wall of a drying unit (1312). For example, as shown in FIG. 1, the drying unit 104 has a top end 161, a bottom end 162, a first side wall 163, and a second side wall 164.

The process 1300 further includes connecting a top dryer end and a bottom dryer end to a second side wall of the drying unit (1314). For example, as shown in FIG. 1, the drying unit 104 has a top end 161, a bottom end 162, a first side wall 163, and a second side wall 164.

The process 1300 further includes inserting, into the drying unit, a drying compartment to a lower side of the top dryer end and an upper side of the bottom dryer end (1316). The drying unit 104 includes a heating compartment 130 extending between a lower side of the top end 161 and an upper side of the bottom end 162. In some implementations, the drying unit 104 includes a drying baffle 132 located in the heating compartment 130. The drying baffle 132 is configured to rotate about an axis 133 that extends between a center of the lower side of the top end 161 and a center of the upper side of the bottom end 162. The rotation of the baffle provides a function of tumbling articles of clothing to aide in a drying process.

The process 1300 further includes connecting a power compartment at the bottom dryer end of the drying unit (1318). For example, as shown in FIG. 1, the power compartment 120 is located at the bottom end 162 of the drying unit 104. In some implementations, the power compartment 120 includes the DC motor 122 and an AC/DC converter 124. The AC/DC converter 124 can be configured to be connected to a standard AC power source (e.g., 120 volts at 60 Hz frequency) by the electrical cable 126 and plug adapter 127. In some implementations, the AC/DC converter 124 can supply power to the heating assembly 135 and fan compartment 140. Alternatively, the power compartment 120 could include a DC battery in lieu of, or in addition to, the AC/DC converter 124.

The process 1300 further includes connecting a fan assembly at the top dryer end of the drying unit (1320). For example, as shown in FIG. 1, a fan compartment 140 includes a fan assembly 142 at the top dryer end 161 of the drying unit 104. In some implementations, the fan assembly 142 includes fans 144, 146, and 148. Alternatively, the fan assembly 142 can include a different number of fans, or even one fan. The fan assembly 142 is configured to rotate about an axis 141 (e.g., a horizontal axis) extending between the first side wall 163 and the second side wall 164 of the drying unit 104, and circulate air within the drying unit 104 during operation. The circulated air is vented through the air vent 138. The operation of the fan assembly 142 and the air circulation within the drying unit 104, is further described herein with reference to FIGS. 7-8.

The process 1300 further includes connecting a heating assembly to the second dryer side wall of the drying unit (1322). For example, as shown in FIG. 1, a heating assembly 135 is coupled to the second side wall 164 of the drying unit 104. In some implementations, the heating assembly 135 includes heating bulbs 136. In some implementations, as shown in FIG. 1, the drying unit 104 includes a power switch 150 coupled to the heating assembly 135. Alternatively, the power switch 150 can be located anywhere accessible by a user on the outside of the drying unit 104, or connected to the drying unit 104 by a power cord. The power switch 150 can be provided in many different forms, such as a toggle switch, electronic push button, heat-sensitive button, slide switch, and so on.

The process 1300 further includes connecting an air vent to the second dryer side wall of the drying unit (1324). For example, as shown in FIG. 1, air vent 138 is coupled to the second side wall 164 of the drying unit 104. During operation, circulated air is vented through the air vent 138.

In some implementations, a process for manufacturing a portable apparatus for washing and drying clothes can further include connecting a second side wall of the washing unit to the first dryer side wall of the drying unit. For example, as shown in FIG. 1, a second side wall 173 of the washing unit 102 is coupled to the first side wall 163 of the drying unit 104.

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. An apparatus for washing and drying clothes comprising:

a washing unit comprising:

a washer top end and a washer bottom end, the washer top end including a securable cover that selectively covers and exposes an opening;

a washing compartment having an inner layer extending between the top washer end to the bottom washer end of the washing unit, the inner layer including a plurality of washing grooves, the washing compartment configured to be collapsible;

a water tube connected from the top washer end to the bottom washer end of the washing unit;

a water hose extending from a side wall of the washing unit at a location that is closer to the top washer end than the bottom washer end of the washing unit; and a wringer coupled to an end of the washing compartment that is closer to the bottom washer end of the washing unit than the top washer end of the washing unit; and a drying unit coupled to the washing unit, the drying unit comprising:

a top dryer end and a bottom dryer end;

a first dryer side wall and a second dryer side wall, wherein the washing unit is configured to be coupled to the first dryer side wall of the drying unit;

a drying compartment extending between a lower side of the top dryer end to an upper side of the bottom dryer end of the drying unit;

a power compartment at the bottom dryer end and coupled to the drying compartment;

a fan assembly at the top dryer end and coupled to the drying compartment;

a heating assembly coupled to the second dryer side wall of the drying unit; and an air vent located in the second dryer side wall of the drying unit.

2. The apparatus of claim 1, further comprising a washer blade assembly coupled to the washing compartment and connected to the washer top end and washer bottom end of the washing unit.

3. The apparatus of claim 2, wherein the washer blade assembly comprises:

a connector;

a first washer blade; and a second washer blade operably coupled to the first washer blade via the connector.

4. The apparatus of claim 2, wherein the washer blade assembly is made of a bendable material and configured to reduce in size when a pressure is applied.

5. The apparatus of claim 1, wherein the heating assembly includes a plurality of heating bulbs.

6. The apparatus of claim 1, wherein the power compartment comprises at least one DC motor.

7. The apparatus of claim 1, wherein the power compartment houses at least one DC motor and an AC/DC converter.

8. The apparatus of claim 7, wherein the AC/DC converter is electrically connected to the heating assembly, DC motor, and fan assembly.

9. The apparatus of claim 1, wherein the drying unit further comprises a drying baffle located in the drying compartment.

10. The apparatus of claim 1, wherein the washing unit further comprises an air release device.

11. The apparatus of claim 10, wherein the air release device includes an air release string configured to release air from the washing compartment after a user pulls the air release device outward from an air release receptacle.

12. The apparatus of claim 1, wherein the fan assembly includes two or more fans.

13. The apparatus of claim 1, further comprising a strap connected to the top end of the drying unit.

14. The apparatus of claim 13, wherein the strap connected to the top end of the drying unit by a first connector and a second connector.

15. The apparatus of claim 13, wherein the strap is adjustable for different lengths.

16. The apparatus of claim 1, wherein the washing compartment is configured to hold at least two gallons of water.

17. The apparatus of claim 1, wherein the water hose comprises a water hose connector.

18. The apparatus of claim 17, wherein the water hose connector is adjustable to connect to a plurality of water sources.

19. The apparatus of claim 1, wherein the water hose connector is configured to connect to the threads of a resealable screw-top container.

20. A method of manufacturing a portable apparatus for washing and drying clothes, comprising:

connecting a securable cover that selectively shields and exposes an opening to a top washer end of a washing unit;

inserting, into the washing unit, a washing compartment having an inner layer between the top washer end and a bottom end of the washing unit, the inner layer including a plurality of washing grooves, the washing compartment configured to be collapsible;

connecting a water tube from the washer top end to the washer bottom end of the washing unit;

connecting a water hose extending from a first side wall of the washing unit at a location that is closer to the top washer end than the bottom washer end of the washing unit;

connecting a wringer to an end of the washing compartment that is closer to the bottom washer end of the washing unit than the top washer end of the washing unit;

connecting a top dryer end and a bottom dryer end to a first dryer side wall of a drying unit;

connecting a top dryer end and a bottom dryer end to a second side wall of the drying unit;

inserting, into the drying unit, a drying compartment to a lower side of the top dryer end and an upper side of the bottom dryer end;

connecting a power compartment at the bottom dryer end of the drying unit;

connecting a fan assembly at the top dryer end of the drying unit;

connecting a heating assembly to the second dryer side wall of the drying unit; and connecting an air vent to the second dryer side wall of the drying unit.

21. The method of claim 20, further comprising connecting a second side wall of the washing unit to the first dryer side wall of the drying unit.

* * * * *